US006644484B1

(12) United States Patent
Sardis

(10) Patent No.: US 6,644,484 B1
(45) Date of Patent: Nov. 11, 2003

(54) MODULAR CLOTHING RACK SYSTEM

(76) Inventor: Peter N. Sardis, 159-44 83rd St., Howard Beach, NY (US) 11414

( * ) Notice: Subject to any disclaimer, the term of this patent is extended or adjusted under 35 U.S.C. 154(b) by 0 days.

(21) Appl. No.: 10/282,389

(22) Filed: Oct. 29, 2002

(51) Int. Cl.[7] ..... A47B 47/00
(52) U.S. Cl. ..... 211/190; 211/189
(58) Field of Search ..... 211/190, 189, 211/191, 206

(56) References Cited

U.S. PATENT DOCUMENTS

| | | | | | |
|---|---|---|---|---|---|
| D180,016 | S | | 4/1957 | Frick | D14/3 |
| 3,121,497 | A | | 2/1964 | Brochstein | 211/178 |
| 3,272,345 | A | | 9/1966 | Wallace | 211/44 |
| 3,303,938 | A | | 2/1967 | Solomon | 211/182 |
| 3,503,525 | A | | 3/1970 | Loebner | 211/177 |
| 3,692,188 | A | | 9/1972 | Bayne | 211/49 D |
| 3,831,768 | A | | 8/1974 | Keller | 211/1 |
| 3,871,525 | A | | 3/1975 | Al-Dabbagh et al. | 211/176 |
| 3,921,814 | A | | 11/1975 | Solomon | 211/162 |
| 4,018,340 | A | | 4/1977 | Gold | 211/44 |
| 4,054,209 | A | | 10/1977 | Solomon | |
| 4,093,078 | A | | 6/1978 | Radek | |
| 4,380,298 | A | * | 4/1983 | Harig | 211/189 |
| 4,535,704 | A | | 8/1985 | Suttles | |
| 4,748,770 | A | * | 6/1988 | Cline | 47/68 |
| 4,819,814 | A | | 4/1989 | Fogelgren | |
| 4,934,858 | A | * | 6/1990 | Beaulieu | 211/192 |
| 5,090,725 | A | | 2/1992 | Feldner | |
| 5,190,305 | A | | 3/1993 | Putman | |
| D336,183 | S | | 6/1993 | Klein | D6/467 |
| 5,299,816 | A | | 4/1994 | Vom Braucke et al. | |
| D357,102 | S | | 4/1995 | Tate | D34/17 |
| 5,439,152 | A | * | 8/1995 | Campbell | 211/195 |
| 5,476,282 | A | * | 12/1995 | Dahl | 280/651 |
| 5,509,541 | A | | 4/1996 | Merl | |
| 5,617,962 | A | | 4/1997 | Chen | |
| 5,906,277 | A | | 5/1999 | Vienneau | |
| 5,941,398 | A | * | 8/1999 | Harris | 211/195 |
| 6,029,833 | A | | 2/2000 | Yeh | |
| 6,223,916 | B1 | | 5/2001 | Enos | |
| 6,364,137 | B1 | | 4/2002 | Glauth et al. | |
| 6,375,202 | B2 | | 4/2002 | Weck et al. | |
| 6,488,160 | B2 | * | 12/2002 | Wang | 211/195 |
| 2001/0015535 | A1 | | 8/2001 | Weck | |
| 2002/0005389 | A1 | * | 1/2002 | Guo | 211/85.3 |
| 2002/0079277 | A1 | | 6/2002 | Huang | |

OTHER PUBLICATIONS

Omaha Fixture International, *Fall 2002 Distributor Catalog*.

* cited by examiner

*Primary Examiner*—Daniel P. Stodola
*Assistant Examiner*—Erica B Harris
(74) *Attorney, Agent, or Firm*—Notaro & Michalos P.C.

(57) ABSTRACT

A clothing rack assembly and system has two or more racks each with a chassis and a pair foldable arms. A pair of support frames are detachably connected to the arms and each includes a pair of upright members made of hollow square tubing. Three sides of the tubing have a line of support holes for supporting hooks of an accessory. The accessory is preferably a hanging rod for connected two of the racks together, and for displaying hanging merchandise in the space between the racks.

10 Claims, 6 Drawing Sheets

72
78
76
18
78
42
40
42
10
70
22
74
86
20
24
28
26
50
88
82
40
19
54
28
60
80
62
52
26
80
42
84
56
58
16
12
64
16
14
16c
106
15
64
16c
108
64

MODULAR CLOTHING RACK SYSTEM

FIELD AND BACKGROUND OF THE INVENTION

The present invention relates generally to clothing racks, and in particular, to a new and useful system comprising various subassembles that together form a highly versatile and portable rack structure for displaying clothing at shows and at points of sale.

The following U.S. patent classifications are believed relevant to the present invention:

| Class | Subclasses |
|---|---|
| 211 | 123, 124, 182, 189, 195, 204, 206 |
| D34 | 23. |

The most pertinent patents are discussed in the following.

Also see Published Patent Application US 2001/0015535 A1 to Weck et al. which describes a cart with a rectangular base on four wheels and a U-shaped handle arising out of receptacles within the base.

U.S. Pat. No. 5,906,277 to Vienneau teaches a collapsible portable storage container comprising a rigid lower base with wheels, a peripheral frame and cross members, a support arising out of the base and comprising a telescoping support pole or member which can be extended out of the support, and swivel mounted arms connected to the support pole, adapted to rotate around a fixed axis on the swivel. The arms may have up-turned ends to hold clothing and equipment. Handles are mounted on the support and adapted to lock or release the telescoping support pole once it has been extended or shortened. A peripheral frame with a central cross member is also horizontally mounted on top of the support pole, and has a telescopic member that can extend away from the frame in a horizontal direction. A cover bag can be mounted over the entire frame of the container.

U.S. Pat. No. 6,375,202 to Weck et al. teaches a cart with a rectangular base on four wheels, a U-shaped handle arising out of receptacles within the base, and a metal hangar bar fixed between legs of the U-shaped handle having hooks adapted to carry household items. The U-shaped handle comprises two legs arising out of opposite receptacles of the base, which then connect to two arms that are bent toward the rear edge of the base, and are joined at the top by a tubular horizontal bar. Two different sets of receptacles on the base allow for the U-shaped handle to placed in two different positions with respect to the base.

U.S. Pat. No. 6,029,833 to Yeh discloses a clothes display rack comprising two horizontal supporting bars, side posts mounted to the supporting bars made of a connection board lying between two vertical posts, and a central rectangular display frame formed from vertical and horizontal bars, wherein the horizontal bars extend beyond the vertical bars and have hollow ends. Brackets horizontally project from the top and bottom of the side posts and can be inserted into the hollow ends of the horizontal bars of the display frame. Display panels, hangars, hooks, and shelves can be attached for hanging and storing a variety of articles. The display rack can also be attached to similar display racks via a central bore in a connection board end portion, through which a bolt and sleeve and can be threaded to receive a nut on the other side.

U.S. Pat. Nos. 3,303,938; 3,921,814 and 4,054,209 to Solomon disclose a variety of garment racks.

U.S. Pat. No. 5,617,962 to Chen teaches a collapsible clothing rack, comprising two parallel and horizontal bars on wheels, a vertical member on each side supported by a horizontal bar, two rods that are pivotably interlocked and connected to the lower ends of the vertical members on each side, pistons slidably inserted within each vertical member and a top tube horizontally supported on the pistons with two extension rods adjustably fastened at opposite ends of the top tube.

U.S. Pat. No. 3,503,525 to Loebner discloses a collapsible rack comprising horizontal support bars on wheels, vertical support bars mounted on the horizontal bars, and horizontal hangar support bars mounted on top of and between the vertical support bars. When the horizontal hangar support is removed, the vertical support bars may be folded inward and the hangar support bar may then be secured to the horizontal bars for portable transport and storage.

U.S. Pat. No. 3,272,345 to Wallace discloses a rack, comprising four vertical upright members on wheels and two tiers of shelves on the ends of the vertical members. The four vertical members contain horizontally aligned slots. The shelves have lugs at one end which can be inserted into the horizontally aligned slots, engaging and supporting the shelves on the vertical members on both sides of the rack.

U.S. Pat. No. Des. 357,102 to Tate illustrates a dolly with a base or platform supported on four wheels, two vertical upright members on both sides of the dolly inserted into recesses within the top surface of the base, and horizontal bars between the vertical members on both sides of the dolly. Telescopic vertical members are also shown connected to the vertical upright members, and adjustable with a lock and release mechanism.

U.S. Pat. No. 6,223,916 to Enos teaches a shelving crossbar having a hook portion for insertion into a vertical slot in a post for supporting shelving and the crossbar. A retainer can be attached to the post at one end via a horizontal tab that can be inserted into a horizontal slot in the post. At the other end of the retainer, a screw hole is provided for accepting a screw to secure the body of the retainer to the crossbar that has been inserted into a vertical slot of the post.

A wide variety of racks and other display structures and attachments can be viewed by visiting the Internet wed site of OmahaFixture International. Their catalog titled "The Global Source for Retailers" is also distributed periodically to the trade.

SUMMARY OF THE INVENTION

It is an object of the present invention to provide a rack system having one or, preferably, more than one collapsible presentation racks for transporting clothing to, and displaying clothing at trade shows. The system of the invention is easily collapsed into compact parts for storage and transport, and is equally easily expanded and assembled into a sturdy and movable system that can be configured and modularized to fit various trade show stall sizes, while maximizing display versatility.

The system of the invention preferably uses two or more unique racks of the invention. Each rack comprises a top bar, a pair of spaced apart, upper frames for supporting the top bar and a wheeled chassis with a pair of collapsible arms for supporting the upper frames.

The chassis comprises a base frame with the arms mounted to opposite ends of the base frame for folding from an inward, substantially horizontally stowed position, to an upwardly extending, substantially vertical support position. Two preferably hollow connecting members or legs connect each upper support frame to each arm of the rack.

The top bar is adjustable in width by having a central horizontal bar with smaller inner horizontal pull-out bars that extend out from both ends of the central bar. The top bar also has support studs that extend vertically downwardly from the central bar, into engagement with upper central openings of the upper frames, to fix the spacing between the upper frames, and hold the rack in a firm, upstanding configuration for use.

The upper frames are constructed of square hollow tubing, and each have at least two, opposite upright members with vertical rows of spaced support holes, e.g. so-called "standard slots," on three specific sides of the tubing. The sides selected for the slots are the inwardly facing sides facing the other upper frame of the same rack, the outwardly facing sides facing either to the left or right of the rack, and the front or rear sides facing either the front or the rear of the rack. The sides of the upright members facing each other on the same upper frame are free of support slots.

One great advantage of the invention is that two racks can be connected to each other by an additional spanning member, such as a hanging rod, connected by suitable hooks at the opposite ends of the hanging rod, to the slots on the outwardly facing sides of the racks. In this way the space between the racks is also used for displaying merchandise, e.g. for hanging clothing to be displayed.

Accordingly, another object of the invention is to provide a clothing rack assembly and system having two or more racks each with a chassis and a pair foldable arms. A pair of support frames are detachably connected to the arms and each includes a pair of upright members made of hollow square tubing. Three sides of the tubing have a line of support holes for supporting hooks of an accessory. The accessory is preferably a hanging rod for connecting two of the racks together, and for displaying hanging merchandise in the space between the racks.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
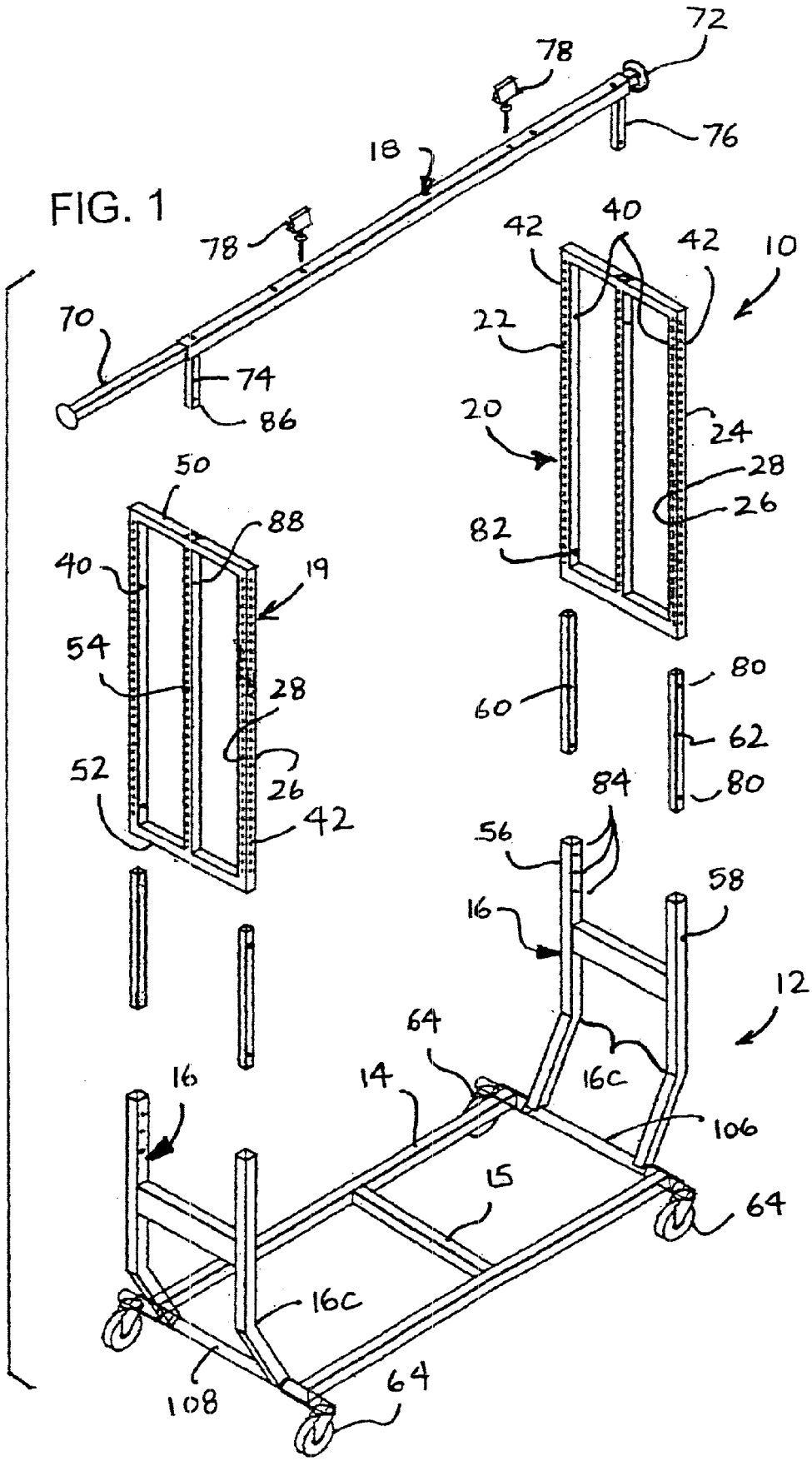
FIG. 1 is an exploded, perspective view of one rack of the system of the present invention.
Figure 6:
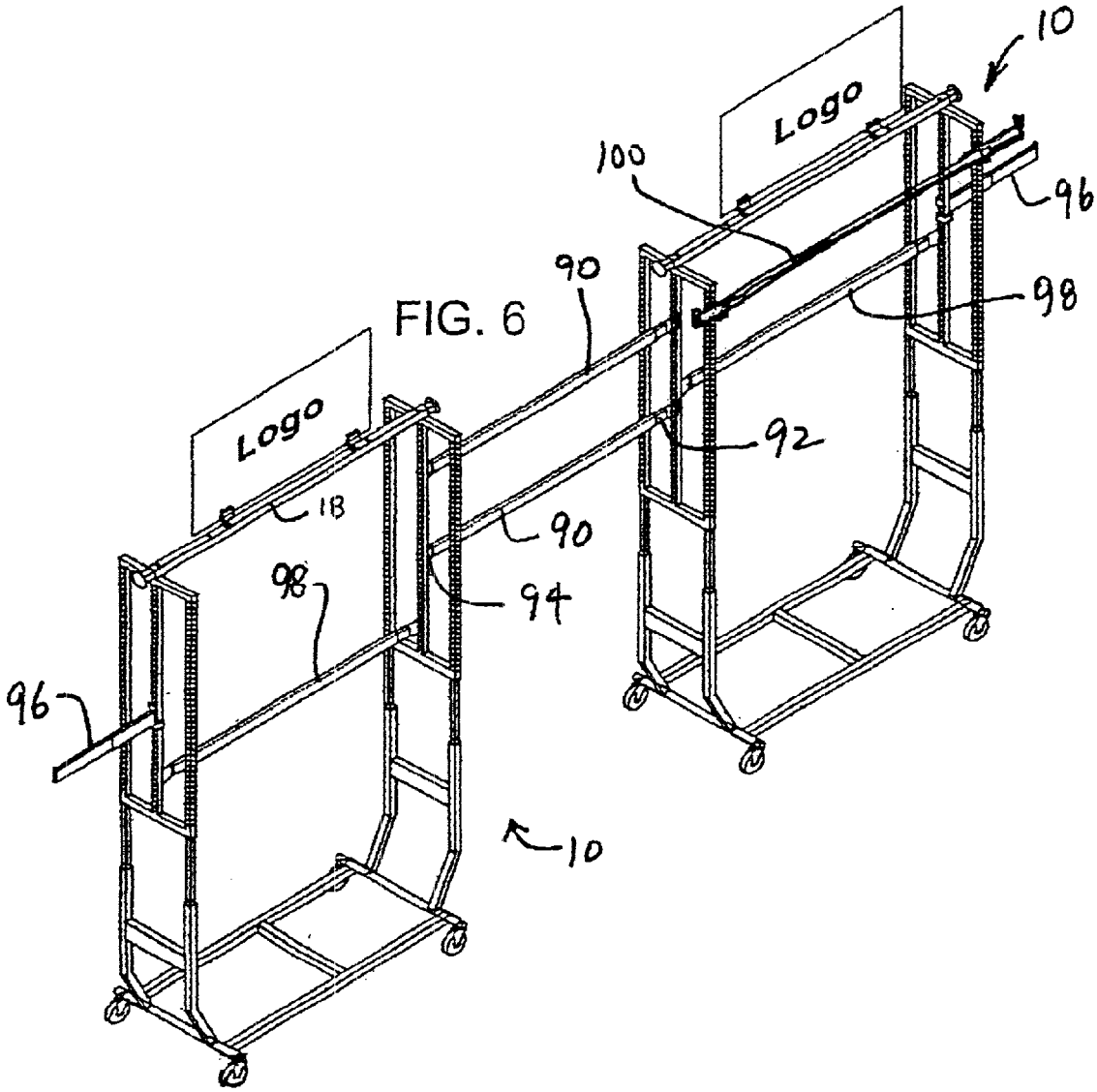
FIG. 6 is a perspective view of two racks of the invention in a modular system of the invention.
Figure 7:
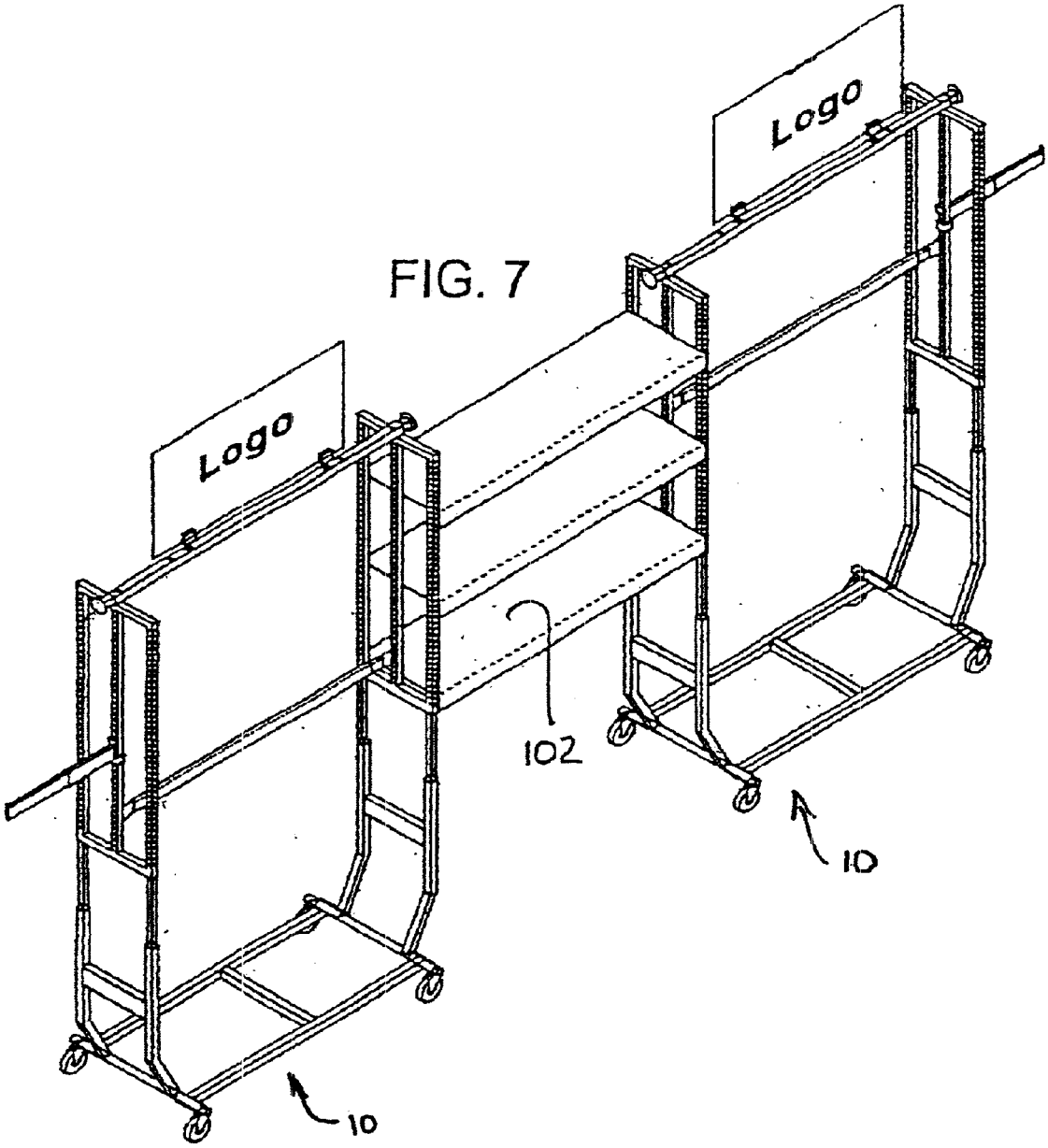
FIG. 7 is a perspective view of two racks of the invention in a further modular system of the invention.
Figure 8:
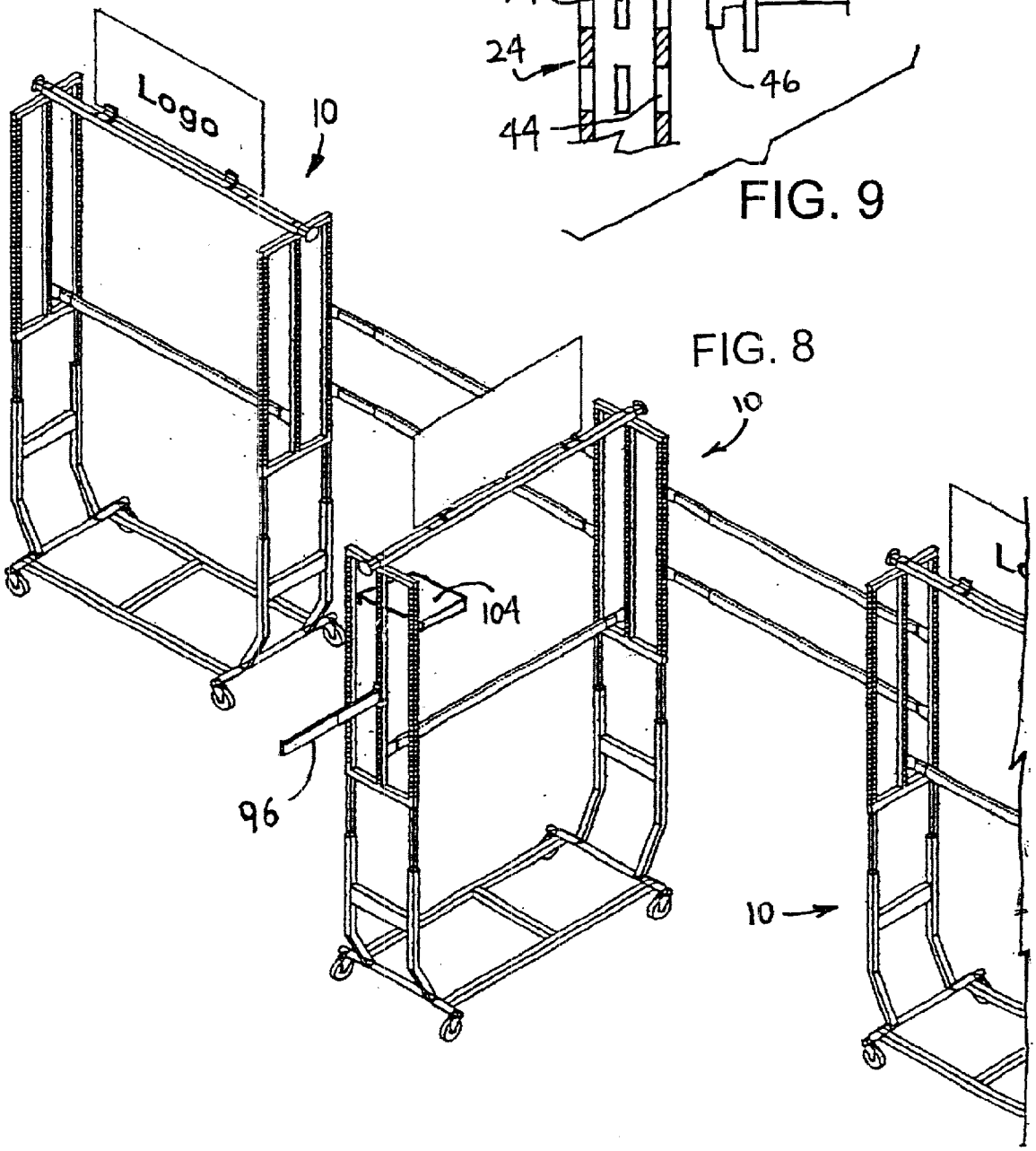
FIG. 8 is a perspective, partial view of three racks of the invention in a still further modular system of the invention.

Referring now to the drawings in which like reference numerals are used to refer to the same or functionally similar parts, FIG. 1 is an exploded view of a clothing rack generally designated 10, for use in a modular clothing rack assembly and system, examples of which are illustrated in FIGS. 6, 7 and 8.

Figure 2:
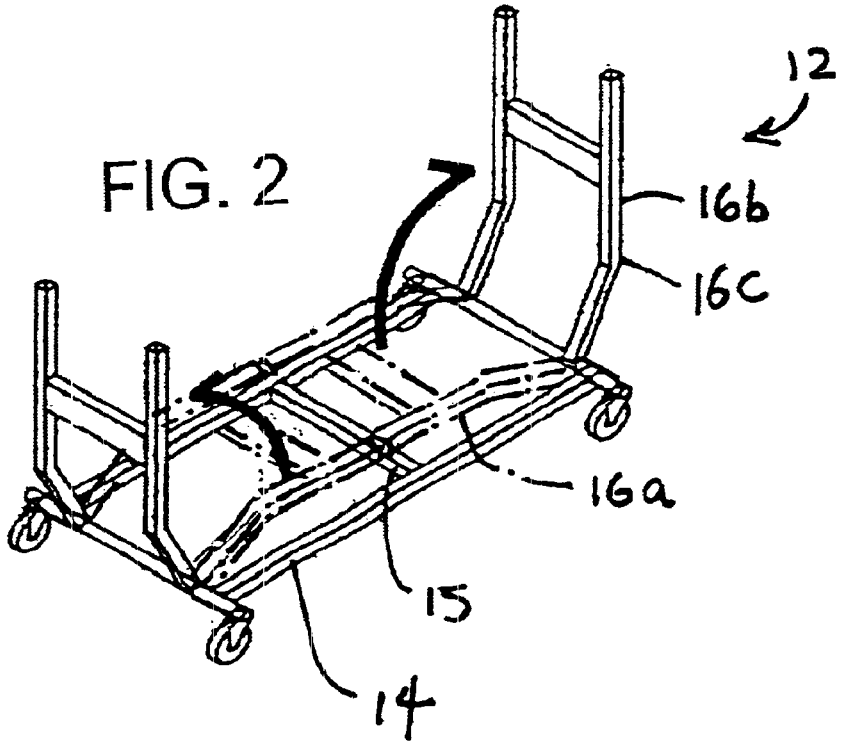
FIG. 2 is a perspective view of a first step for unfolding and assembling the rack of FIG. 1.
Figure 3:
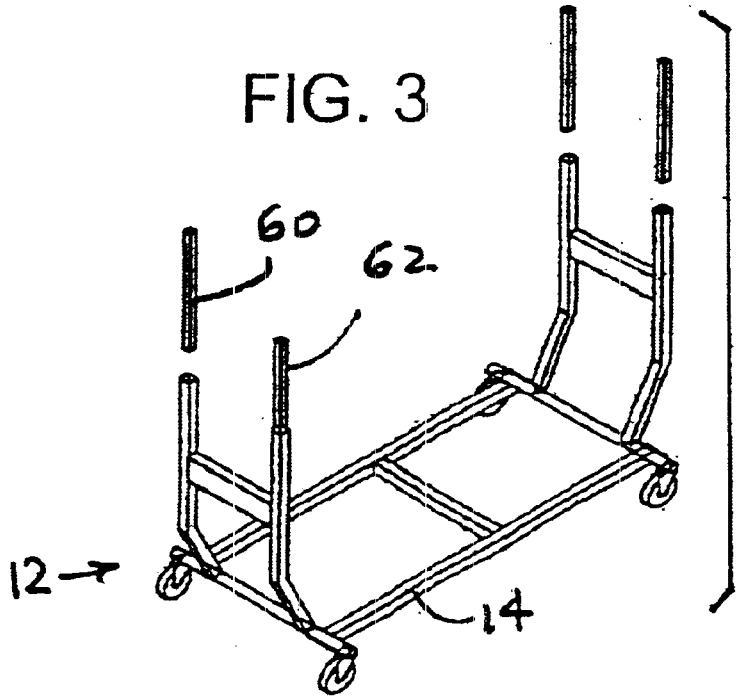
FIG. 3 is a view like FIG. 2 of a second step for assembling the rack.
Figure 4:
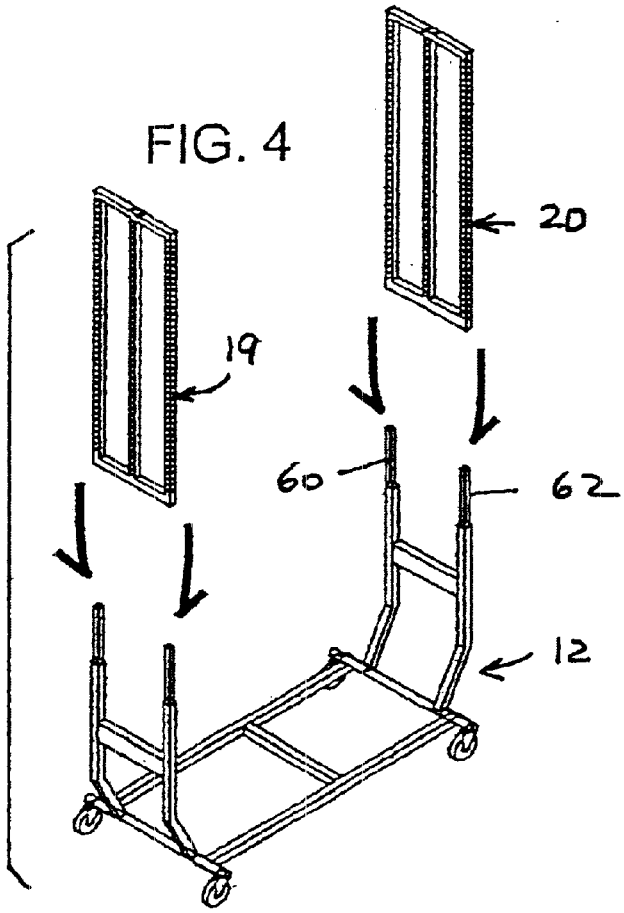
FIG. 4 is a view like FIG. 2 of a third step for assembling the rack.
Figure 5:
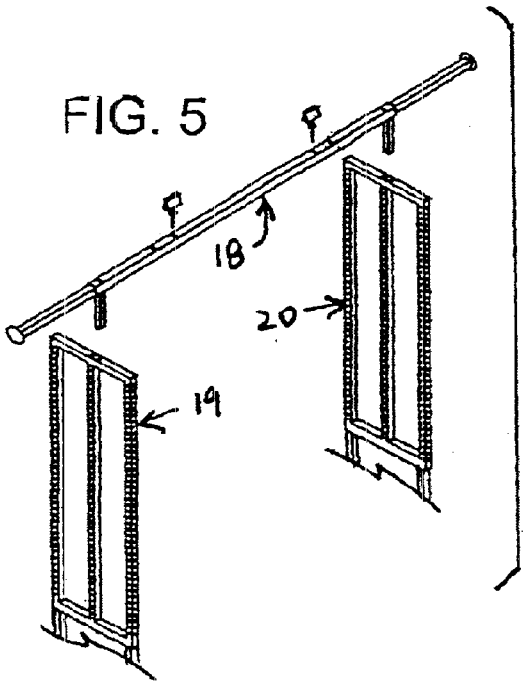
FIG. 5 is a view like FIG. 2 of a fourth step for assembling the rack.

Rack 10 comprises a chassis 12 made up of a base or base frame 14 and a pair of spaced apart support arms 16, pivotally mounted to opposite ends of the base. To begin erection of rack 10, each arm 16 is pivoted from a lowered, substantially horizontal stowed position shown in phantom line at 16*a* in FIG. 2, to substantially vertical support position 16*b*, in the direction of the arrows in FIG. 2. In stowed position 16*a*, the arms can rest on a cross member 15 of base frame 14, to form a compact configuration for shipping and storage of the chassis 12. The pivotal motion in the direction of the arrows in FIG. 2 is stopped by stops between the base and the arms, when the arms 16 are upright in their position 16*b*. As will be explained later in this disclosure, arms 16 are prevented from collapsing to their stowed position 16*a* by a top bar 18 visible in FIG. 1, detachably connected across the top of rack 10.

A pair of upper support frames 19 and 20 a is detachably connected to upper ends of each arm 16 in the support positions of the arms, as also illustrated in FIG. 1. Each upper support frame 19, 20 includes a spaced apart pair of upright members 22 and 24, made of hollow metal square tubing. Each upright member 22, 24 has a first side 26 facing inwardly of the rack and toward the upright member of the other frame of the rack. Each also has a second side 28 facing outwardly and in an opposite direction from the first side 26. A third side 40 of each square upright member face inwardly toward the other upright member of the same frame and a fourth side 42 faces outwardly to a front or rear of the rack 10 and in an opposite direction from the third side 40 of that upright member.

Figure 9:
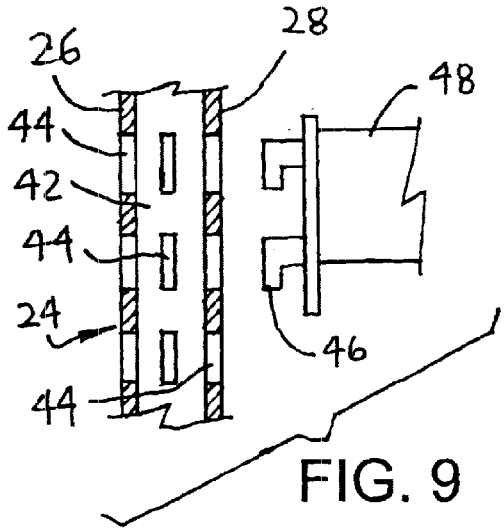
FIG. 9 is an enlarged, partial, sectional view of a section of square tubing of the upper frame support, and a hook fitting for the support openings in the tubing.

A vertically and evenly spaced line of support holes 44, such as half inch or one inch standard slots, are provided in each of the first 26, second 28 and fourth 42 sides of each upright member 22 and 24 as show in enlarged form in FIG. 9. Each hole or slot is for engaging and supporting a standard hook structure 46 of a display accessory 48. The display accessory, which may have a wide variety of shapes and functions, has the hook structures 46 for engaging at least one, but usually two of the support holes 44 of at least one of the upright members for detachably connecting the accessory to, and supporting the accessory on, the rack 10.

Although the term "square tubing" is used, this term is meant to include other tubing having e.g. a rectangular or other cross-sectional shape. The only limitations are that it be strong enough to support itself and the merchandise to be displayed on the rack, and that it have at least the three sides for the three vertical rows of spaced support holes. The holes 44, although preferably standard slots, can be any other shaped holes provided on the three specified sides of each upright member. "Standard slots" are known as such in the display industry and are particularly useful since a wide variety of accessories are commercially available for standard hook structures for engaging such standard slots. Again see the products available from OmahaFixtures International.

As also illustrated in FIG. 1, each upper support frame 19 and 20 of rack 10 includes upper and lower cross members 50 and 52 connected between the pair of upright members 22 and 24, and a central member 54 connected between the upper and lower cross members 50, 52. Central member 54 extends vertically between the upright members 22 and 24, and has opposite first and second sides facing in the same respective directions as the first and second sides 26, 28, of the upright members. A vertical and evenly spaced line or set of support holes 44 is also provided in each of the first and second sides of the central member 54 for engaging and supporting a hook structure of accessories.

Each arm 16 has a bend 16*c* so that with the arms in the support position 16*b*, the arms extend upwardly and outwardly from the base 14 and then, at the bend, the arms extend vertically above the bend. The base frame 14 is a peripheral frame that carries the cross member 15 of the base. Bends 16*c* also allow the arms in position 16*a* to lie flat against the cross member 15 (FIG. 2) and be as compact as position, as noted above.

Each arm also includes a pair of spaced apart arm members 56 and 58 which include the bend 16*c*. The rack also includes a pair of vertical connecting members or posts 60 and 62, that are detachably connected between each upright member 22, 24, of each support frame 19, 20, and each arm member 56, 58, of the arms 16.

A rack has a set of four casters or pivotally mounted wheels 64 connected to the peripheral frame of the base 14 for rolling the rack. Top bar 18 is detachably connected between the upper ends of the support frames 19 and 20 by studs 74 and 76 extending down into central openings at the top center of each cross member 50 shown in FIG. 1.

The top bar 18 is hollow and includes opposite open ends each with an extendable pull-out bar 70 and 72 supported in each open end of the top bar. A pair of forks 78 are plugged into holes at the top of bar 18 for supporting a sign, e.g. a plaque carrying a trademark or "Logo" for the merchandise displayed on the rack (see FIGS. 6, 7 and 8).

FIGS. 2, 3, 4 and 5, illustrate the sequence of assembly for the rack with arrows showing the direction of engagement for the various parts of the rack. As shown in FIG. 1, spring loaded push buttons 80 of know design are provided at the opposite ends of each connecting member 60 and 62. The upper end of a connecting member 60 or 62 is inserted into a bottom receiving hole at the bottom of an upright member 22 or 24 and button 80 springs out into a stopping hole 82 in that upright member. The same procedure is followed for the lower end of each connecting member and the lower button is allow to spring out into any one of three holes 84 in the arm member 56 or 58. This provides some adjustment of the total height of the rack 10. Similar push buttons 86 on the bar studs 74 engage holes 88 on the central member for securing the top bar 18 to the frames 19 and 20.

As illustrated in FIG. 6, a preferred form of the rack accessory is a hanging bar 90 having opposite pull-out end bars 92 each with one of the hook structures 94 for connecting to two spaced apart sets of support holes on two racks 10. Hook structures 94 are the same type as shown in FIG. 9 at 46, and serve to support the hanging bar 90 between the racks 10, 10. In this way merchandise, e.g. clothing can be displayed in the space between the racks and the two racks plus the bar 90 together form an elongated rack assembly or system. The system is variable in overall width due to the pull-out nature of the bars 92 which can vary the size of the space between the racks to properly fill a trade show booth.

Other accessories can be used with one or more racks to form rack assemblies of the invention. For example, a cantilevered and telescopic hanging bar 96 can be hooked to the support slots on any side of the support frame members for added hanging locations. Hanging bars 98 with opposite pull-out bars and hook structures can also be connected between the central members 54 of the support frames of one rack 10 for hanging clothing in the rack. Bar 98 can be aligned with bar 90 to give the impression of one long hanging bar, or they can be off-set or two or more bars can used in the racks or between the racks.

A hanging bar 100 or other display accessory can even be supported in front of one or both racks by supports with hook structures connected to the fourth front sides 42 of the upright members 24 at the front of a rack. The forks 78 on top bars 18 are shown holding a plaque with an arbitrary trademark "Logo" on it in FIG. 6.

FIG. 7 illustrates how a pair of parallel hanging bars between the upright members of the two racks can be used to support a self 102 between the racks. This is because the upright members 22 and 24 of each support frame 20 of FIG. 1, have second outer sides or surfaces 28 with rows of support holes, as well as the central member 54. Shelf 102 is simply a flat metal planar part on top with a pair of downwardly extending side flanges that embrace the bars with the planar part on top of the bars.

The presence of the support holes on three sides of the uprights also permits the even more versatile system of racks shown in FIG. 8. FIG. 8 also illustrates a cantilever shelf 104 which can be supported across two parallel cantilever bars 96 hooked into support holes on the inner first sides of the frame upright members of one of the racks, or at any other location with two spaced apart sets of vertical support holes.

All of the members of the racks can be made of metal square tubing although other suitable materials can also be used. Parts with multiple members such as the frames 19, 20, the base 14 or the arms 16, have their parts welded together. The end members 106 and 108 of base frame 14 may, however be cylindrical with the arms 16 welded to an outer cylinder that pivots on an inner cylinder or shaft carrying the wheels 64 and fixed to the rest of base frame 14.

One wheel 64 on each end member 106 and 108, is also a locking wheel so that the rack, when used as a display rack, can be locked in place on the floor. Preferably, the wheels which are diagonally across from each other on the base frame 14 are locking wheels while the other two wheel are not.

While a specific embodiment of the invention has been shown and described in detail to illustrate the application of the principles of the invention, it will be understood that the invention may be embodied otherwise without departing from such principles.

What is claimed is:

1. A modular clothing rack system, comprising:

at least two racks, each rack having;

a chassis with a base and a pair of spaced apart support arms each movably mounted to the base between a substantially horizontal stowed position, and a substantially vertical support position;

a pair of upper support frames each detachably connected to an upper end of one of the arms in the support position of each arm;

each upper support frame including a spaced apart pair of upright members made of hollow square tubing, each upright member having a first side facing inwardly toward an upright member of the other frame of the rack, a second side facing outwardly in an opposite direction from the first side, a third side facing toward the other upright member of the same frame, and a fourth side facing to a front or rear of the rack and in an opposite direction from the third side;

a vertically and evenly spaced line of support holes in each of the first, second and fourth sides of each upright member for engaging and supporting a hook structure; and at least one connecting accessory for connecting the two racks to each other, the accessory having opposite ends each with at least one of the hook structures for engaging at least one of the support holes of the upright member of each of the two racks and for displaying merchandise on the accessory and between the two racks.

2. A system according to claim 1, wherein each upper support frame includes upper and lower cross members connected between the pair of upright members, and a central member connected between the upper and lower cross members, the central member extending vertically between the upright members and having opposite first and second sides facing in the same respective directions as the first and second sides of the upright members of the same rack, and a vertically and evenly spaced line of support holes in each of the first and second sides of the central member for engaging and supporting a hook structure.

3. A system according to claim 2, wherein each support hole is a standard slot for receiving and supporting a hook structure for a standard slot.

4. A system according to claim 2, wherein each arm has a bend so that with the arms in the support position, the arms extend upwardly and outwardly from the base and then, at the bend, the arms extend vertically above the bend, the base comprising a peripheral frame and a cross member.

5. A system according to claim 4, wherein each arm includes a pair of spaced apart arm members, each rack including a pair of vertical connecting members detachably connected between each upright member of each support frame and each arm member of an arm connected to that support frame.

6. A system according to claim 5, including a set of wheels connected to the peripheral frame of each base for rolling each rack, at least one of the wheels being a locking wheel.

7. A system according to claim 1, wherein each support hole is a standard slot for receiving and supporting a hook structure for a standard slot.

8. A system according to claim 1, including a top bar detachably connected between upper ends of the support frames.

9. A system according to claim 8, wherein the top bar is hollow and includes opposite open ends, each including an extendable pull-out bar supported in each open end of the top bar.

10. A system according to claim 1, wherein the accessory comprises a hanging bar having opposite pull-out end bars each with one of the hook structures for connecting the two racks.

* * * * *